United States Patent [19]

Ladriere

[11] Patent Number: 4,932,326

[45] Date of Patent: Jun. 12, 1990

[54] FIERCING PROJECTILES

[76] Inventor: Serge Ladriere, "Le Cottage" 27, Boulevard du Plan des Abeilles, 06230 Saint-Jean-Cap Ferrat, France

[21] Appl. No.: 469,806

[22] Filed: Jan. 22, 1990

Related U.S. Application Data

[63] Continuation of Ser. No. 314,064, Jan. 19, 1989, abandoned.

[30] Foreign Application Priority Data

May 27, 1987 [FR] France ..... 8707487
May 25, 1988 [WO] PCT Int'l Appl. ... PCT/FR88/00264

[51] Int. Cl.[5] ..... F42B 12/44; F42B 12/62

[52] U.S. Cl. ..... 102/364; 102/489; 102/514; 102/517

[58] Field of Search ..... 102/364, 383, 473, 480, 102/489, 514–519, 522

[56] References Cited

U.S. PATENT DOCUMENTS

| | | | |
|---|---|---|---|
| 3,277,825 | 10/1966 | Millard | 102/518 |
| 3,418,878 | 12/1968 | Stricklin . | |
| 3,948,184 | 4/1976 | Pierre et al. | 102/522 |
| 4,648,324 | 3/1987 | McDermott . | |
| 4,706,569 | 11/1987 | Wallow et al. | 102/518 |
| 4,708,063 | 11/1987 | Ladriere | 102/518 |

FOREIGN PATENT DOCUMENTS

| | | | |
|---|---|---|---|
| 477375 | 10/1915 | France | 102/489 |
| 864439 | 4/1941 | France | 102/489 |
| 917369 | 1/1947 | France . | |
| 2356906 | 1/1978 | France . | |
| 2479971 | 10/1981 | France . | |
| 108268 | 8/1917 | United Kingdom | 102/489 |
| 2110799 | 6/1983 | United Kingdom . | |

OTHER PUBLICATIONS

Patent Abstracts of Japan, vol. 1, No. 2, Mar. 4, 1977, p. 184 m76 & JP, A, 51113400 (Honbucho) Jun. 10. 1976.

*Primary Examiner*—Harold J. Tudor
*Attorney, Agent, or Firm*—Larson and Taylor

[57] ABSTRACT

The projectile includes a main projectile (1) of the calibre of the weapon, and containing at least one axial bore (2) open towards the tip; an axuliary projectile (3) lodged in the said bore (2) of the calibre of the said bore (2), a propulsive charge (4) being arranged between the bottom of this bore (2) and the said auxiliary projectile (3); a triggering device (5) to ignite the propulsive charge (4) in order to effect firing of the auxiliary projectile (3) before or at the moment of impact of the main projectile (1) on its target. An explosive and/or incendiary charge is arranged in the main projectile (1) in front of the auxiliary projectile (3) before it is fired. Means for igniting this charge are provided and arranged so as to be triggered automatically immediately the auxiliary projectile (3) is fired.

6 Claims, 1 Drawing Sheet

FIERCING PROJECTILES

This application is a continuation of application Ser. No. 07/314,064 filed Jan. 19, 1989, now abandoned.

FIELD OF THE INVENTION

The invention relates to piercing projectiles and comprises a main projectile having the caliber of the weapon and in which is provided at least one axial bore that opens towards the front and. Housed in said bore, is an auxiliary projectile having the caliber of said bore, a propulsive charge being placed between the bottom of this bore and said auxiliary projectile.

A triggering device is provided to ignite the propulsive charge in order to cause the auxiliary projectile to be fired before or at the time of impact of the main projectile on its target.

SUMMARY OF THE INVENTION

Such piercing projectiles, whose piercing effect is thus brought about, on the one hand, by the auxiliary projectile and, on the other hand, by the main projectile, are known in the art. The object of the invention is to confer on them additional destructive properties, particularly as regards explosives and/or incendiary effects.

For this purpose, the main projectile comprises at least one explosive and/or incendiary charge located in the main projectile ahead of the auxiliary projectile before it is fired. Means for igniting this explosive and/or incendiary charge are provided and arranged so as to be triggered automatically immediately after the auxiliary projectile has been fired.

According to a preferred form of embodiment of the invention, these means for igniting the explosive and/or incendiary charge are sensitive to the passage of the auxiliary projectile through the axial bore provided in the main projectile.

Such igniting means can then take the form of at least one channel placing the axial bore provided in the main projectile in communication with the explosive and/or incendiary charge.

The axial bore can comprise grooves whose pitch is such that the angular velocity generated on the auxiliary projectile is added to that imparted to said auxiliary projectile by the main projectile.

Structurally speaking, it is advantageous to provide securing means to make the auxiliary projectile before it is fired, integral in rotation with the main projectile. Such securing means can take the form of a self-clamping tapered sleeve.

This self-clamping tapered sleeve between the auxiliary projectile and the main projectile also serves as a means for temporarily retaining the auxiliary projectile in the axial bore and makes it possible to optimize the manner in which the auxiliary projectile gains speed (axial velocity and speed of rotation) when the propulsive charge is ignited.

Apart from the arrangements just discussed, the invention consists of a number of means which are preferably used at the same time and which will be described in greater detail below.

The invention can be readily understood, in any case, with reference to the description which follows as well as the annexed drawing, both of which relate to a preferred and, of course, non limitative embodiment of the invention.

DETAILED DESCRIPTION OF THE PREFERRED EMBODIMENTS

Figure 2:
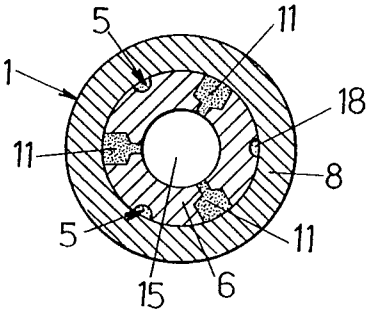
FIG. 2 is a cross section along line II-II of FIG. 1.
Figure 1:
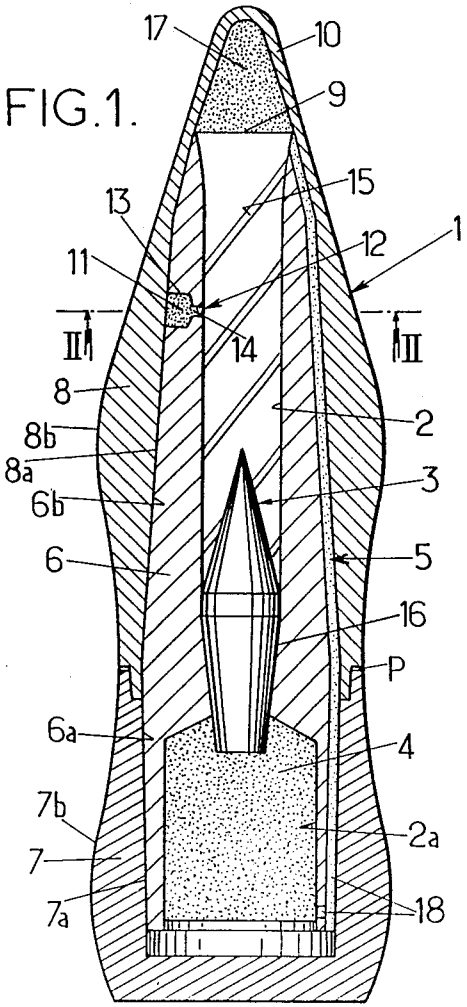
FIG. 1 of this drawing is an axial cross section of a projectile according to the invention.

The piercing projectile according to the invention, can be produced in calibers such as 12.7 mm (0.50) which is the one used in most machine guns currently in service.

However, it is perfectly possible to contemplate applying the invention to other calibers, in particular: 15 mm, 20 mm, 25 mm, 30 mm, 35 mm, 40 mm or even larger calibers.

The piercing projectile comprises:

a main projectile 1 at least partially made of hard material (steel), this main projectile matching the caliber of the weapon; (a) an axial bore 2 opening towards the front being provided in this main projectile, coaxially with its axis of axial symmetry, and; (a) housed in this axial bore 2, an auxiliary projectile 3 essentially made of a hard material (steel), this auxiliary projectile matching the caliber of said bore 2, and (b) a propulsive charge 4 being placed between the bottom of this bore and said auxiliary projectile.

A triggering device, generally identified by reference number 5 which will be described in greater detail below, is provided to ignite the propulsive charge 4 in order to cause auxiliary projectile 3 to be fired before or at the time of impact of the main projectile 1 on its target.

In one advantageous embodiment of this main projectile 1, it is formed of several parts, namely:

a central core 6 made of a hard material (steel), or a material that is both hard and heavy (tungsten); this central core comprising a rear portion **6*a* having the shape of a truncated cone whose diameter decreases rearwards and a front portion 6*b* having the shape of a truncated cone whose diameter decreases forwards, a rear shoe 7 made of a material less hard than steel (brass) and having a frustroconical bore 7*a* suitable for fitting over the frustroconical rear portion 6*a* of the central core 6; whereby bore 7*a* and rear portion 6*a* form a self-clamping or tightening conical sleeve coupling this rear shoe 7 comprising an area in the shape of an annular bulge 7*b* the outside diameter of which is such that it engages with the rifling of the gun from which the projectile according to the invention is fired, a front cap 8 made of a material less hard than steel (brass) and having a frustroconical bore 8*a*, suitable for fitting over the frustroconical front portion 6*b* of the central core 6, this front cap 8 comprising an area in the form of an annular bulge 8*b*** whose outside diameter is such as to cooperate with the rifling of the gun from which the projectile according to the invention is fired.

The above mentioned rear shoe 7 and the above-mentioned front cap 8 are interconnected at a plane of junction P. The outside diameter of the projectile according to the invention at this plane of junction P being less than the outside diameter of rear shoe 7 in the region of annular bulge **7*b* and less than the outside diameter of front cap 8 in the region of annular bulge 8*b***, in proportions such that the hollow linking the two above mentioned annular bulges is not in contact with the gun from which the projectile according to the invention is fired.

The axial bore 2 of such a projectile is thus provided in central core 6 at the front of which there is a mouth 9 covered by the point 10 of front cap 8 which is thin in the area of this mouth 9.

To confer destructive properties upon such a projectile, particularly as regards explosive and/or incendiary effects, main projectile 1 comprises one or preferably several explosive and/or incendiary charges 11 located in the main projectile 1 forward of auxiliary projectile 3 before it is fired. Means for igniting this explosive and/or incendiary charge 11, generally identified by reference 12, are provided and arranged so as to be triggered automatically after immediately auxiliary projectile 3 has been fired.

It is advantageous to arrange these explosive and/or incendiary charges 11 between central core 6 and front cap 8.

For this purpose there are provided by cavities 13 circumferentially spaced at regular intervals and provided in central core 6, each of these cavities 13 containing an explosive and/or incendiary substance and being closed by the inner wall of front cap 8.

It is an advantage for the means 12 for igniting these explosive and/or incendiary charges 11 to be designed so that they are sensitive to the passage of auxiliary projectile 3 through bore 2.

In this case, there is provided at least one channel 14 placing axial bore 2 in communication with each explosive and/or incendiary charge 11 housed in its cavity 13.

The igniting of propulsive charge 4 causes auxiliary projectile 3 to be fired. Immediately after auxiliary projectile 3 has passed the outlets of channels 14 into bore 2, the hot gases from propulsion charge 4 penetrate into channels 14 leading and ignite the explosive and/or incendiary charges housed in cavities 13.

Axial bore 2 can comprise riflings 15, the pitch of which is such that the angular velocity generated on auxiliary projectile 3 is added to the angular velocity imparted by main projectile 1 to said auxiliary projectile 3.

It is an advantage to provide securing means to make auxiliary projectile 3, before it is fired, integral in rotation with central core 6 of main projectile 1. Such means are formed by a self-clamping tapered sleeve 16 between the rear portion of auxiliary projectile 3 and the bottom of axial bore 2, said means being provided in the central core 6.

This self-clamping tapered sleeve 16 between auxiliary projectile 3 and central core 6 also serves as a means of temporarily retaining auxiliary projectile 3 in axial bore 2 and makes it possible to optimize the gain in speed of auxiliary projectile 3 (axial velocity and rotational velocity) when the propulsive charge is ignited.

To increase the volume of propulsive charge 4, it may be an advantage to provide an area **2*a* of enlarged diameter at the bottom of axial bore 2**.

The triggering device 5 provided for the purpose of igniting propulsive charge 4 in order to cause auxiliary projectile 3 to be fired can comprise:

a proximity detonating fuse 17 placed at the front of the projectile, for example between the point 10 of the front cap 8 and mouth 9 via which axial bore 2 emerges from central core 6, and one, or preferably several, conduits 18, containing a pyrotechnical substance and linking up this proximity detonating fuse with propulsive charge 4;

these conduits 18 can be provided between central core 6, on the one hand, and rear shoe 7 and front cap 8, on the other hand.

Structurally speaking, it can be seen that a projectile according to the invention can be made in all calibers.

However, it will be appreciated that the smaller the caliber the greater the difficulty in producing it.

It is thus reasonable to assume that, to achieve a level of production compatible with large scale manufacturing criteria at non prohibitive costs, any caliber of less than 12.7 mm (0.50), without being excluded from the field of application of the invention, can be discarded at least in the initial stage.

In the case of caliber 12.7 mm, (0.50), it is possible to adopt an embodiment similar to that illustrated in the annexed drawing: the same would also apply to a caliber of 15 mm.

As to larger calibers 20 mm, 25 mm, 30 mm, 35 mm, 40 mm, 50 mm and above, the architecture of the projectile according to the invention could be more freely designed given the dimensions that the components of the projectile could then have.

As it goes without saying and as is apparent from the preceding description, the invention is in no way limited to those of its modes of application and embodiments that have been more particularly contemplated; it embraces on the contrary, all possible variations thereof.

I claim:

1. A piercing projectile having a longitudinal axis of symmetry and intended to be fired by a weapon having a rifled barrel, said piercing projectile comprising:

a main piercing projectile matching the caliber of the rifled barrel, said main piercing projectile having a rear shoe and a central core, said rear shoe being made of a relatively soft material for engagement with the rifling of the barrel and having an outside diameter such that it engages the rifling of the rifled barrel, said central core being made of a relatively hard material compared with that of said rear shoe and having an outside diameter such that it does not engage the rifling of the rifled barrel, a self-tightening conical sleeve coupling means for securing said rear shoe and said central core together;

a single axially rifled bore provided coaxially with the longitudinal symmetry axis in said central core and opening towards a front of said central core, the rifling of said axial rifled bore being in the same rotational direction as the rifling of the rifled barrel;

an auxiliary piercing projectile housed in said rifled bore and matching the caliber of said rifled bore, said auxiliary piercing projectile being arranged to engage the rifling of said rifled bore;

a propulsion charge placed between a bottom of said rifled bore and said auxiliary projectile;

a proximity detonating fuse which is detonated when said piercing projectile is reaching a target;

a triggering means which is actuated by said proximity detonating fuse for igniting said propulsive charge to cause said auxiliary projectile to be fired;

at least one secondary charge located in said central core; and an ignition means provided between said rifled bore and said secondary charge for, when said auxiliary piercing projectile after being fired passes in front of said ignition means, automatically igniting said secondary charge.

2. A piercing projectile according to claim 1, wherein the secondary charge is an explosive charge.

3. A piercing projectile according to claim 1, wherein the secondary charge is an incendiary charge.

4. A piercing projectile according to claim 1, wherein said self-tightening conical sleeve coupling means comprises:

a frustoconical rear portion provided on said central core, said frustoconical rear portion having a diameter decreasing rearwards, and a frustoconical bore provided in said rear shoe, said frustoconical bore being suitable for fitting over the frustoconical rear portion of said central core.

5. A piercing projectile according to claim 1, wherein said central core comprises a frustoconical front portion whose diameter decreases forwards; and a front cap having a frustoconical bore provided for fitting over said front portion of said central core, said front cap being made of a relatively soft material for engagement with the rifling of the barrel, said front cap comprising an area in the form of an annular bulge the outside diameter of which is such that it engages the rifling of the rifled barrel.

6. A piercing projectile according to claim 1, wherein said ignition means comprises at least one channel provided in said central core for placing said rifled bore in communication with secondary charge.

* * * * *